US008719980B2

(12) United States Patent
Chen

(10) Patent No.: US 8,719,980 B2
(45) Date of Patent: May 13, 2014

(54) PRESSURE-ULCER-PREVENTION DYNAMIC CUSHION

(76) Inventor: John Yanhao Chen, New Taipei (TW)

( * ) Notice: Subject to any disclaimer, the term of this patent is extended or adjusted under 35 U.S.C. 154(b) by 54 days.

(21) Appl. No.: 13/235,364

(22) Filed: Sep. 17, 2011

(65) Prior Publication Data

US 2012/0068510 A1 Mar. 22, 2012

(30) Foreign Application Priority Data

Sep. 17, 2010 (TW) ..... 99131535 A

(51) Int. Cl.
*A47B 7/00* (2006.01)

(52) U.S. Cl.
USPC ..... 5/613; 5/191; 5/236.1; 5/934; 297/311

(58) Field of Classification Search
USPC ..... 5/108, 109, 933, 934, 935, 613, 652, 5/191, 236.1, 161, 612; 601/46, 56–60; 297/311
See application file for complete search history.

(56) References Cited

U.S. PATENT DOCUMENTS

| | | | | |
|---|---|---|---|---|
| 2,112,367 | A * | 3/1938 | Hyter | 601/98 |
| 6,986,180 | B1 * | 1/2006 | Wilke | 5/618 |
| 7,467,426 | B1 * | 12/2008 | Jarmon et al. | 5/191 |
| 7,905,846 | B2 | 3/2011 | Ganti | |
| 2004/0221390 | A1 * | 11/2004 | Frey | 5/613 |
| 2005/0120481 | A1 * | 6/2005 | Farmont et al. | 5/618 |
| 2010/0275376 | A1 * | 11/2010 | Benzo et al. | 5/618 |

* cited by examiner

*Primary Examiner* — Michael Trettel
*Assistant Examiner* — Myles Throop

(57) ABSTRACT

This invented multiple-phase dynamic cushion comprises a frame, at least a driving source, at least a transmission assembly, and clusters of plural strips interleaved in parallel. Taking a two-phase embodiment as an example, the two-phase strips interleave with each other, in parallel, to form the cushion's surface and alternate their tensions in turn; when one phase's strips periodically tighten to support the user's body, the other phase's strips will loosen, allowing the user's body covered by the loosened strips to take a rest, averting a pressure-ulcer risk. The driving source is energized by an altering energy, making the two strip groups alternate in loosening and tightening states periodically in turn. This invention can be converted into a portable dynamic chair when the four holes on the bottom of its four corners are inserted with legs; it can also be converted into a dynamic support for a lying human body.

20 Claims, 8 Drawing Sheets

PRESSURE-ULCER-PREVENTION DYNAMIC CUSHION

CLAIM OF PRIORITY

This application claims the benefit of Taiwan Patent Application No. 099131535, filed Sep. 17, 2010, the complete contents of which is hereby incorporated herein by reference.

BACKGROUND OF THE INVENTION

1. Field of the Invention

This application relates generally to human body support cushions and more particularly to dynamic cushions for pressure-ulcer prevention. Still more particularly it relates to a dynamic cushion with a surface made of parallel tension-alternating strip clusters pulled or pushed by periodically linearly-moving strip-tail connectors.

2. Description of Related Art

The surfaces of the cushions available in the current market, including all makes of materials such as animal skin, rubber, bamboo, straw, wood, palm fiber, tea leaf, rice husk, and so on, and artificial materials, such as cloth, plastic sheet, artificial fibers, foams, gel, water bags, air bags, springs, and so forth, are mostly not air-passable, which causes the cushion user's buttocks and the area surrounding the user's private part easy to cumulate moisture and get moist tetter or itchy. The capillary and minute vessels in that area, being pressed for too long, will gradually clog up, leading the area into ischemia and making the area's skin feel burning and uneasy. Should the pressure not be released for too long, pressure ulcer will ensue. The pressure-relieving and pressure-ulcer-prevention effects of such traditional cushions are far from ideal.

The present invention not only breaks up the static structure of the traditional cushions and provides a user an excellent effect in pressure relieving and pressure-ulcer prevention but also renders an air-circulation effect at the user's body-contact interface, which is a clear advantage over currently existing air-bladder-type cushions, air-cell-type cushions (e.g. ROHO™ made) or gel-type cushions. This invention uses only one single driving source, not two driving sources, to control all its two-phase embodiments; such design, at least, substantially reduces cost, space, weight, and energy consumption, an economical, convenient and environmentally-protecting method in making a health product for life.

SUMMARY OF THE INVENTION

The invention provides a dynamic cushion which comprises: (a) a frame, (b) at least a driving source, (c) at least a transmission assembly, mechanically linked to the driving source(s) at one end, and firmly connected to plural horizontal, longitudinal strip-tail connectors, which are separate from said frame and can horizontally move linearly transverse-wise in said frame's internal free space, at the other end, and (d) at least two, representing multiple-phase, interleaved-in-parallel strip clusters, including at least one strip cluster representing the odd phase and at least one strip cluster representing the even phase. The odd-phase strip cluster's head is (clusters' heads are) first fastened to the frame's one transverse side; the odd-phase strip cluster is (clusters are) then transversely wrapped across the frame's top surface and around the frame's other opposite transverse side so as to, respectively, fasten the strip cluster's tail (clusters' tails) to corresponding odd-phase strip-tail connector (connectors). Similarly, the even-phase strip cluster's head is (clusters' heads are) fastened to the frame's other transverse side; the even-phase strip cluster is (clusters are) then transversely wrapped across the frame's top surface and around the frame's one transverse side so as to, respectively, fasten the strip cluster's tail (clusters' tails) to corresponding even-phase strip-tail connector (connectors) in order to make the multiple-phase strip clusters produce, in turn, periodical, tension-and-relaxation-alternating, multiple-phase variations to avert any health hazards such as pressure ulcers.

The invention, from other embodiment with a two-phase structure, also provides a dynamic cushion that comprises: (a) a frame; (b) a driving source, having two output shafts; (c) a transmission assembly, having an inner end pair mechanically linked to the driving source, and an outer end pair in the opposite transverse sides respectively connected to two horizontal strip-tail connectors in the frame. The two strip-tail connectors are driven periodically by the driving source, in synchronism, moving periodically back and forth horizontally; and (d) two interleaved-in-parallel strip clusters, respectively representing two phases, with the first-phase strip cluster's head being fastened to the frame's one transverse side. The first-phase strip cluster is transversely wrapped across the frame's top surface and around the frame's other transverse side so as to fasten the strip cluster's tail to the first-phase strip-tail connector. The second-phase strip cluster's head is fastened to the frame's the other transverse side; the second-phase strip cluster is transversely wrapped across the frame's top surface and around the frame's one transverse side so as to fasten the strip cluster's tail to the second-phase's strip-tail connector in order to make the two strip clusters produce periodical, tension-and-relaxation-alternating, two-phase synchronized variations to avert any health hazards such as pressure ulcers.

The invention, from yet another embodiment with a three-phase structure, also provides a dynamic cushion that comprises: (a) a frame; (b) three driving sources; (c) three transmission assemblies, with their one end being respectively and mechanically linked to the three driving sources, and the other end being respectively connected to three horizontal, strip-tail connectors, which are separate from said frame and can horizontally, or near horizontally, move linearly transverse-wise in said frame's internal free space. The odd-phase and the even-phase strip-tail connectors are divided into, and located at, the two opposite transverse sides in the frame, in order to make the three strip-tail connectors, being respectively driven by the three driving sources in sequence, move periodically back and forth in sequence horizontally; and (d) one first-phase strip cluster, one second-phase strip cluster and one third-phase strip cluster, being interleaved in numerical phase sequence and in parallel to constitute the frame's top surface, with the first and the third phases' strip-cluster heads being fastened to the frame's one transverse side, and the first and the third phases' strip clusters being transversely wrapped across the frame's top surface and around the frame's other transverse side so as to fasten the first phase and the third phase strip clusters' tails to the odd-phase strip-tail connectors. The second-phase strip cluster's head is fastened to the frame's the other transverse side; the second phase's strip cluster is transversely wrapped across the frame's top surface and around the frame's one transverse side so as to fasten the second phase strip cluster's tail to the even-phase strip-tail connector in order to make the three strip clusters produce periodical, tension-and-relaxation-alternating, three-phase variations to avert any health hazards such as pressure ulcers.

DESCRIPTION OF THE PREFERRED EMBODIMENTS

The invention includes four subsystems: (1) a frame, (2) at least a driving source, (3) at least a transmission assembly, and (4) plural, interleaved-in-parallel strip clusters divided into multiple phases. Hereinafter, the left-most digit of each part/component numeral shall numerically correspond to one of the above-listed subsystems; viz., 1 stands for frame 1, 2 driving source(s), 3 transmission assembly (assemblies), and 4 all plural strip clusters.

Figure 1:
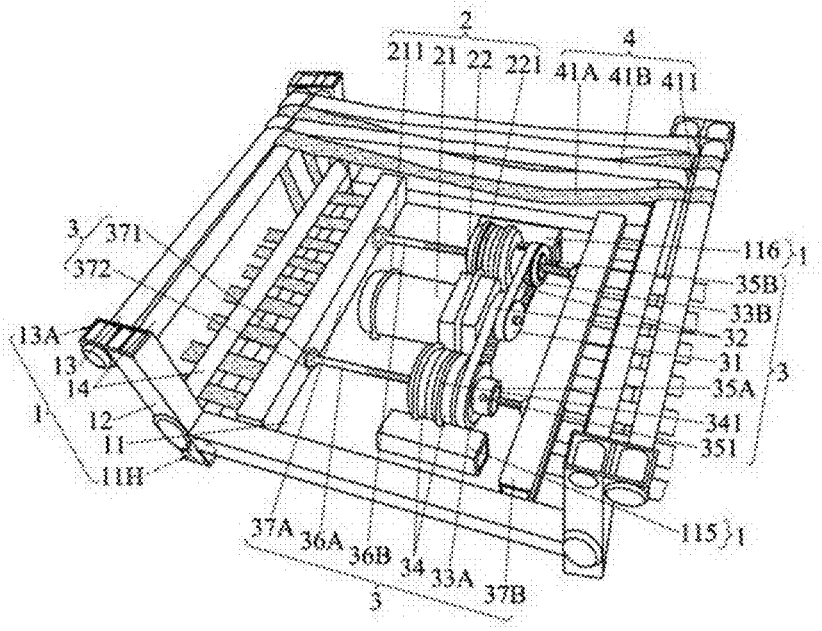
FIG. 1: The structural view of a two-phase embodiment

Two example molds, Mold 1 and Mold 2, for the invention's two-phase embodiments are used to explain and specify the present invention. The Mold 1 of the two-phase embodiments is shown in FIG. 1. The Mold 2 of same is shown in FIGS. 2A, 2B, 3, and 4, where FIG. 2A indicates a tightened first strip cluster and a loosened second strip cluster, FIG. 2B a tightened second strip cluster and a loosened first strip cluster, FIG. 3 the top view of FIG. 2A, and FIG. 4 the front view of FIG. 2A.

The definition of directions adopted herein remains consistent throughout the entire specification and is as follows: Referring to FIG. 1 as we face the cushion's front side, the cushion's front-to-rear line is called the longitudinal direction, and the left-to-right line the transverse direction; the cushion portion corresponding to our left side is defined as the left, and the same criteria are applied to the rest of the other directions, such as the right, the front, and the rear.

Mold 1

As shown in FIG. 1, the Mold 1 of the two-phase embodiments comprises four subsystems: (1) a frame, (2) a driving source, (3) a transmission assembly, and (4) two interleaved-in-parallel strip clusters representing the two phases. Frame 1 includes: base 11 (having four bottom side beams as part of the base), four vertical posts 12 (preferred in tube or pipe shape) erected from the four corners of base 11, two longitudinal fastening rods 13 installed between, and in the upper side of, each of the two longitudinal vertical-post pairs 12, with the right-side fastening rod 13 being used to fasten the head end of the first strip cluster 41A, i.e. Phase A, and the left-side fastening rod 13 to fasten the head end of the second strip cluster 41B, i.e. Phase B, four fastening-rod braces 13A, each longitudinal pair being used to hold the two fastening rods 13 respectively, and four longitudinal strip-turning rods 14, the upper pair 14's for the first 90° strip turning, and the lower pair 14's the second 90° strip turning (FIG. 1).

Note that a shortened term "strip head" will be used to represent "the head (end) of a strip cluster" or "a strip-cluster's head (end)", and "strip tail" to "a strip-cluster's tail end" for simplicity hereinafter.

The lower 90°-strip-turning rod pair 14's are respectively installed between, and near the bottom of, each two vertical longitudinal post pair 12's (FIG. 1) in said frame's two opposite transverse sides in order to respectively bend the associated phases' transverse-wise strip clusters, passing downward through, about 90° from vertical downward direction to about flat horizontal direction inward the frame's bottom center in order to respectively link said strip clusters' tails 41A, 41B to the longitudinal strip-tail connector pair 37A, 37B which is separate from the frame and is transverse-wise linearly movable in said frame's internal lower space.

On base 11, a front and a rear support bases 115, 116 are added in order to secure transmission assembly 3, while the rest of the base surface 11 is substantially planar. The base surface 11 may be partially removed, in any numbers of pieces or shapes (not shown), to reduce the weight of base 11 as long as no noticeably detrimental effect on base 11's structure strength in weight support appears; this principle is applicable to all other embodiments of the present invention.

Four 3D holes 11H are respectively embedded at the bottom of base 11's four corners (see FIG. 1, or refer to FIG. 2A), ready to be inserted with four legs of suitable length having a cross-section shape identical to the holes but a dimension slightly smaller than that of the holes. Without the legs, the cushion can be applied to a chair/bed/wheelchair surface, a ground or lawn, or a floor mat such as Japanese tatami. With the inserted legs, the invention can be turned into a portable dynamic chair and used independently or a bed to support a lying human body; the same feature is applicable to all other embodiments.

Frame 1 provides a support for the user's body weight and a housing and linkage for the other three subsystems. The two left- and right-side strip-head fastening rods 13 respectively fasten the two phases' strip heads. Thus, with driving source 2's pulling tight Phase-A strip cluster 41A's tail end (hereafter called "strip tail") fastened to Phase-A strip-tail connector 37A and letting loose Phase-B strip tail fastened to Phase-B strip-tail connector 37B, simultaneously, with both said strip-tail connectors 37A, 37B being separate from said frame and can horizontally, or near horizontally, move linearly transverse-wise in said frame's internal free space (FIG. 1), for about half a cycle then reversing the tension states on both phases, we will complete the tension-alternating control on the two strip clusters 41A, 41B. The four turning rods 14 will transmit the tensions at the two strip-tail connectors 37A, 37B to frame 1's top surface 4 via a (nearly) 180-degree (2×90 degrees) angular bending, as shown in the top-rear side of FIG. 1, in order to support the user's weight with one of the two strip clusters 41A, 41B, in turn. Both longitudinal ends of the four turning rods 14 maybe embedded with outer bearings (not shown), one at each end. Note that FIG. 4 of the Mold 2 for the two phase embodiments shall help illustrate the (nearly) 180-degree looping of the two strip clusters 41A, 41B.

Driving source 2 includes: a motor 21, which is firmly attached on said base 11. with a motor securing clamp 211 (FIG. 1), a speed-reduction gearbox 22, and a speed-reduction gear-box securing clamp 221. Via the third subsystem 3, driving source 2 will convert its rotational alternations into tension alternations in the two strip clusters 41A, 41B. Transmission assembly 3 includes: a pulley 31, belts 32, being looped over pulley 31, pulleys 33A, 33B, being associated with strip-tail connectors 37A, 37B via screw shafts 36A, 36B, bearing sets 34 (each set comprises plural bearings), being associated with strip-tail connectors 37A, 37B, securing clamp 341, nut plugs 35A, 35B, being associated with strip-tail connectors 37A, 37B, too, bolt pins 351, attaching nut plugs 35A, 35B to the rotation axes of pulleys 33A, 33B, nuts 371, securing screw shafts 36A, 36B to strip-tail connectors 37A, 37B, and plural reinforcement washers 372 for plural nuts 371.

The operation principles of the Mold 1 of the two-phase embodiments are as follows:

Definition of forward rotation, reverse rotation: Viewing from the right of FIG. 1 to its left toward motor 21 and pulley 31, they rotate forwardly if they rotate clockwise to us, which is also called "forward rotation" hereinafter; to the opposite, "rotate reversely" or "reverse rotation." The same rule or definition applies to all other embodiments hereinafter.

As pulley 31 rotates forwardly, belts 32 will also rotate forwardly, making nut plugs 35A, 35B rotate forwardly to drive screw shafts 36A, 36B, within said nut plugs 35A, 35B, and move same screw shafts 36A, 36B along with strip-tail connectors 37A, 37B, which are separate from said frame and can move horizontally, or near horizontally, transverse-wise with said screw shafts 36A, 36B in said frame's internal free space, linearly toward the right (FIG. 1), tightening Phase-A strip cluster 41A (the dark strips in FIG. 1) and loosening Phase B strip cluster 41B (the white strips in FIG. 1), in synchronism.

Both strip-tail connectors 37A, 37B and strip-head fastening rods 13 are rigid which will not bend or only bend minutely when exerted pulling forces, mostly by the weight of the user. Said strip-tail connectors 37A, 37B have two through holes along their transverse direction, being symmetric longitudinally, between their front and rear ends respectively for further mechanical linkage to said transmission assembly's screw shafts 36A, 36B, respectively, as shown in FIG. 1. The same principle applies to all other embodiments.

On the contrary, when pulley 31 rotates reversely, belts 32 will also rotate reversely, driving nut plugs 35A, 35B into reverse rotation and making screw shafts 36A, 36B rotate, accordingly, and move linearly and horizontally toward the left (FIG. 1), gradually loosening Phase-A strip cluster 41A and tightening Phase-B strip cluster 41B, in synchronism. The strip-cluster state shown in FIG. 1 indicates a loosened Phase-A strip cluster 41A and a tightened Phase-B strip cluster 41B, a state at or nearing the end of pulley 31's reverse rotation.

When pulley 31's reverse rotation ends, an external control signal will instruct motor 21 to stop, wait for about half a cycle, and, next, rotate and drive pulley 31 clockwise to complete pulley 31's forward rotation to fully tighten Phase-A strip cluster 41A and loosen Phase-B strip cluster 41B, reaching an opposite state. Next, the external control signal will instruct motor 21 to stop again, wait for about half a cycle, then proceed with reverse rotation. Like this, the cycle will be completed and then started all over again.

The total number of the strips for the two phases' clusters 41A, 41B is usually between 4 and 36, which can be further adjusted as needed, particularly for supporting a lying human body. In selecting strip materials, thick canvas, natural fiber, chemical fiber, other artificial fibers and/or the mixture of the aforesaid materials are acceptable as long as the woven strips out of these materials to be used are flexible and not prone to rupture, with little or no extendibility, and exhibit a flat surface. The individual strip's thickness and width can vary according to the total number of strips used and other practical considerations.

Aiming at reducing the number of driving sources needed, the two strip heads of strip clusters 41A, 41B are first fastened on fastening rods 13, respectively; then the strip tails of same strip clusters 41A, 41B, via strip-tail connectors 37A, 37B, are linked to the two opposite transverse sides of screw shafts 36A, 36B, as shown in FIG. 1, in order to force the two strip clusters 41A, 41B share a single driving source, such as a motor 21. With this design, the single motor 21 will "jointly drive" the two strip clusters 41A, 41B, in synchronism but opposite tension states, cutting down the number of needed driving sources into half (from two to one), which is a great saving in cost, space, weight, maintenance needs, and energy consumption. This is a great advantage of the invention. Furthermore, the control scheme for motor 21 is also simplified with the "jointly-driving" method, another welcome merit.

In case we want to "separately drive" (vs. "jointly drive") the two strip clusters 41A, 41B, we will add an extra driving source (just call it 21', not shown) atop the current motor 21 to drive each phase independently. Such "separately-driving" method requires an extra motor (not shown), increasing production and maintenance costs, needed space, weight, and energy consumption, without any noticeable advantage, and, hence, is not recommended by the inventor.

Concluding from the aforesaid instructions and referring to FIG. 1, the Mold 1 of the two-phase embodiments can be generalized for any multiple-phase embodiments of this invention. Viz., the invented dynamic cushion is built by using:

(a) a frame, which comprises: a weight-support base, having four vertical posts respectively erected on the four corners of the base, and two horizontal and longitudinal rigid and straight fastening rods respectively installed between, and near the top of, each two vertical posts in the frame's two opposite transverse sides to fasten the strip (clusters') heads;

(b) at least a driving source, such as a motor;

(c) at least a transmission assembly, with one end of which being respectively and mechanically linked to a driving source (the driving sources), and the other end of which being respectively connected to plural horizontal, longitudinal strip-tail connectors, which are separate from said frame and periodically moved back and forth horizontally and linearly, in turn, in said frame's internal free space by the driving source (sources), respectively, with the exception of a two-phase structure wherein two strip-tail connectors are synchronously driven by a single driving source. Each transmission assembly comprises: a gearbox pulley, being connected to the driving source; a pulley pair, being respectively linked to the gearbox pulley with a belt; a screw-shaft pair installed in parallel, being respectively connected to the pulley pair through a nut-plug and also being respectively connected to a longitudinal, strip-tail connector for all multiple phase embodiments, with the exception of a two-phase embodiment where the screw-shaft pair will be connected to two synchronized, longitudinal, strip-tail connectors, being placed in the two opposite transverse sides in the frame's internal free space and moved in opposite tension states; and the aforesaid strip-tail connector(s); and (d) multiple, respectively representing multiple-phase, interleaved-in-parallel strip clusters, with the odd-phase strip cluster's head (clusters' heads) being fastened to the frame's one transverse side, and the odd-phase strips being transversely wrapped across the frame's top surface and around the frame's other opposite transverse side so as to, respectively, fasten the strip cluster's tail (clusters' tails) to corresponding longitudinal strip-tail connector (connectors), and with the even-phase strip cluster's head (clusters' heads) being fastened to the frame's other transverse side, and the even-phase strips being transversely wrapped across the frame's top surface and around the frame's one transverse side so as to, respectively, fasten the strip cluster's tail (clusters' tails) to corresponding longitudinal strip-tail connector (connectors) which can horizontally, or near horizontally, move linearly transverse-wise in said frame's internal free space, in order to make the strip clusters produce, in turn, periodical, tension-and-relaxation-alternating, multiple-phase variations so as to avert any health hazards to the user such as pressure ulcers or the like.

Mold 2

Figure 2A:
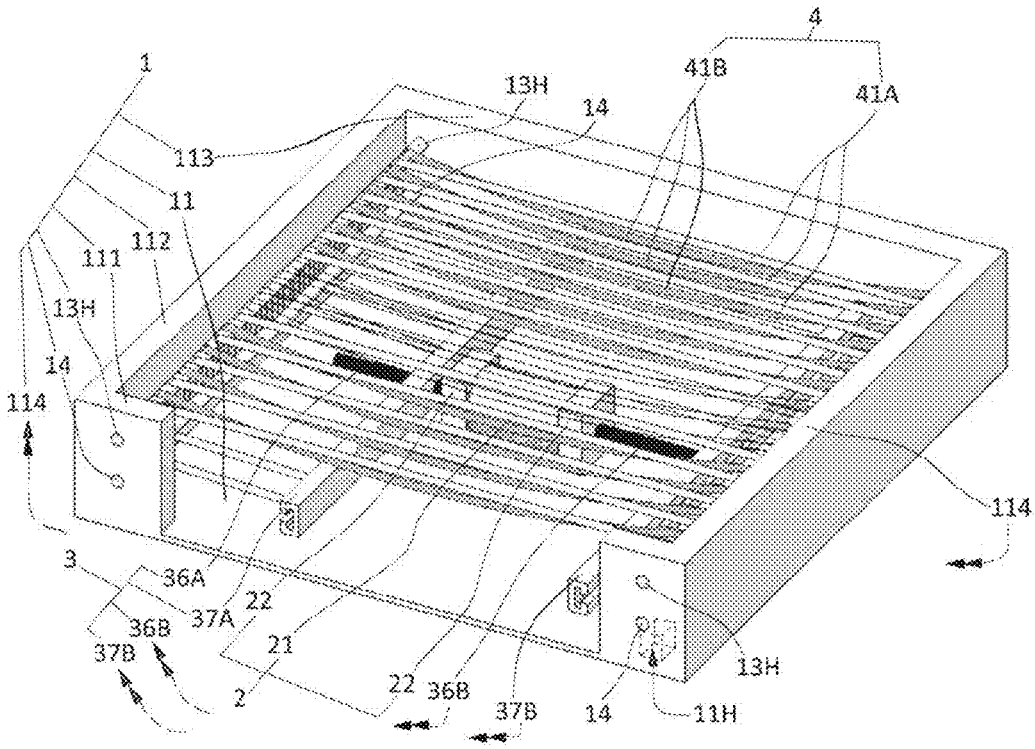
FIG. 2A: The structural view of another two-phase embodiment—Phase A strips being tightened while Phase B strips is loosened

The Mold 2 of the two-phase embodiments, as shown in FIGS. 2A, 2B, 3 and 4, includes four subsystems: (1) a frame 1, (2) a driving source 2, (3) a transmission assembly 3, and (4) two plural, interleaved-in-parallel strip clusters 4 divided into two phases, A and B. As shown in FIG. 2A, Phase-A strip cluster 41A is tightened while Phase-B strip cluster 41B is loosened, and in FIG. 2B, Phase-B strip cluster 41B is tightened while Phase-A strip cluster 41A is loosened. The four subsystems further comprise:

(1) Frame 1, which is mainly used to support the user's weight and contain and uphold other subsystems' components and parts, including: base 11 installed below the strip clusters for weight support of a driving source and a transmission assembly (FIGS. 2A, 4), base 11's front-, left-, rear-, and right-side side-wall boards 111~114, two special fastening rods 13H, the right one of which being jointly used for Phase A's strip-head fastening and Phase B's first strip turning, and the left one of which for Phase B's strip-head fastening and Phase A's first strip turning, and two strip-turning rods 14, for the second strip turning of both phases' strip clusters 41A, 41B, respectively. Said strip turning rods 14's of both phases at the lower frame respectively bend said two phases' strip clusters 180° or about 180° from said two corresponding fastening rods 13H's at the higher frame (FIGS. 2A, 2B, 4) into an entirely opposite direction to respectively reach said frame's the other lower opposite transverse sides, wherein said two phases' strip tails are respectively fastened in phase sequence to said two phases' parallel strip-tail connectors 41A, 41B, which are separate from said frame and are linearly movable transverse-wise in said frame's lower internal free space. Both ends of rods 13H and rods 14 maybe embedded with outer bearings (not shown), one at each end.

As shown in FIG. 2A, around the longitudinal right-side rod 13H, the heads of the "odd-numbered strips" 41A, being counted from the very front of rods 13H, e.g. the first, the third, the fifth strips . . . etc., representing Phase-A strip cluster's head and belonging to the "odd-numbered phase", or the "odd phase", are firmly fastened, while the other "even-numbered strips" 41B, being also counted from the very front of rods 13H, representing Phase-B strip cluster and belonging to the "even-numbered phase" or "even phase", make a first (nearly-)90-degree turn, with the transverse even-phase strips being interleaved in parallel, respectively, with the transverse odd-phase strips and in a sequential order, viz. strips 1, 2, 3, 4, 5 . . . etc. The definition of the aforesaid "odd-numbered phase" or "odd phase" and "even-numbered phase" or "even phase" applies to all other embodiments of this invention. Similarly, around the longitudinal left-side rod 13H, the heads of the even-phase strips 41B are firmly fastened while the odd-phase strips 41A make a first (nearly-)90-degree turn.

There exist four facing-down 3D holes 11H, each being respectively embedded at each of the four corners of base 1's bottom, with one hole 11H being perspectively shown in FIG. 2A. The holes 11H may be inserted with four legs (not shown) of suitable length having a cross-section shape identical to, but a dimension slightly smaller than that of, the holes in order to turn this invention into a portable dynamic chair and have it used independently, when needed.

Figure 3:
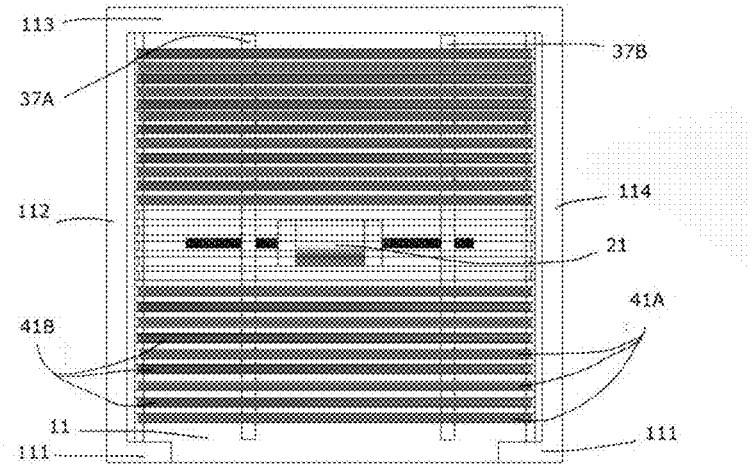
FIG. 3: The top view of FIG. 2A FIG. 4: The front view of FIG. 2A FIG. 5: The structural view of a three-phase embodiment
Figure 4:
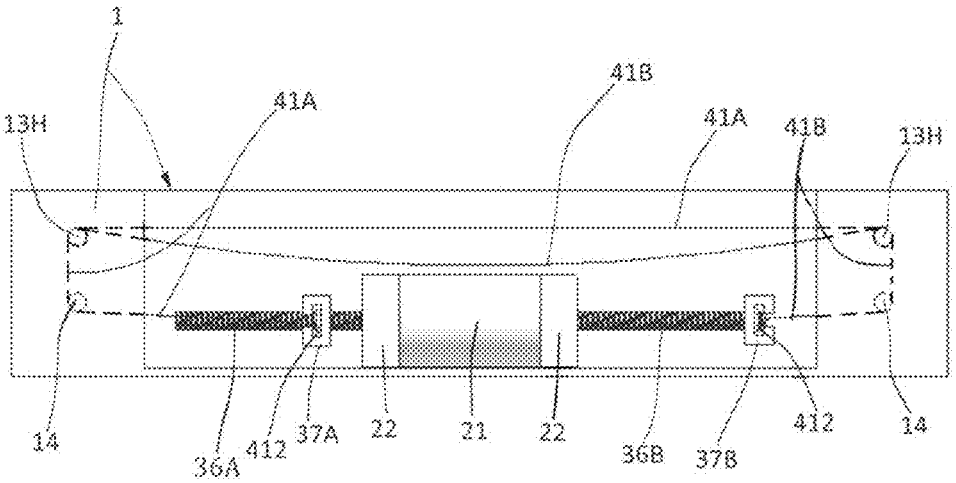

(2) Driving source 2, including: a motor 21 equipped with two shafts protruding in both sides and being linked to two suitable speed-reduction gearboxes 22, such as in-line planetary gearboxes, or the like. The two output shafts of the two gearboxes 22, being installed transversely in the two opposite sides of gearboxes 22 and in straight line with screw shafts 36A, 36B, are next respectively linked to screw shafts 36A, 36B of transmission assembly 3. As shown in FIGS. 2A, 2B 3 and 4, the two outer ends of screw shafts 36A, 36B respectively spin through a transverse-wise through-hole near or at the longitudinal center of the two strip-tail connectors 37A, 37B, which are separate from said frame and can horizontally, or near horizontally, move linearly transverse-wise in said frame's internal free space. The hole is made with a thread matching that of screw shafts 36A, 36B or/and with the hole's inside (concave side) wall being affixed or welded with a nut 412, as shown in FIG. 4, to match screw shafts 36A, 36B. Consequentially, screw shafts 36A, 36B will transmit driving source 2's periodical, bi-direction rotations into linear back and forth movements to strip-tail connectors 37A, 37B, further delivering periodical tension-and-relaxation-alternating movements to the two strip clusters, 41A, 41B, reversely in phase, in order to avert any health hazards, such as pressure-ulcer or the like, to the user.

To minimize the rotation friction, if needed, shafts 36A, 36B and strip-tail connectors 37A, 37B may be replaced with two ball screws (not shown), with the connectors amounted on the nuts of the ball screws.

Should a not-in-line (for input and output shafts) gearbox or a single-shaft motor (not shown) be used, the aforesaid linear movements on strip-tail connectors 37A, 37B still can be achieved by adjusting the relative positions of motor 21 and gearbox 22. E.g., should a single-shaft motor be used, the motor can be placed in a position perpendicular to, and between, the two screw shafts 36A, 36B, with an in-line double-output-shaft gearbox inserted among, and mechanically linked to, motor 21 and the two screw shafts 36A, 36B. In other words, the single-shaft motor (not shown) will be longitudinally placed, with its shaft being linked to a reduction gearbox (not shown) having one input axis perpendicular to two transversely-running in-line output axes protruding in the two opposite transverse sides of the gearbox (not shown), wherein the two gearbox output axes will be respectively connected to screw shaft pair 36A, 36B.

Between the two parallel strip-tail connectors 37A, 37B, which are evenly-spaced and can horizontally, or near horizontally, move linearly transverse-wise in said frame's internal free space (FIGS. 2B, 3 and 4), and on their horizontal plane, at least two diagonal tension braces (not shown) shall be added, forming an "X"-shape, to the outer half of the rectangle formed by strip-tail connectors 37A, 37B with the braces' two front ends fastened to two locations close to, or at, the two front ends of strip-tail connectors 37A, 37B, and the braces' other two rear ends fastened to two locations close to the middle of strip-tail connectors 37A, 37B to impart further rigidity to the rectangle (not diamond) shaped by the parallel strip-tail connectors 37A, 37B. Additional "X"-shape using additional two diagonal tension braces (not shown) may be added similarly to the inner half of the rectangle formed by strip-tail connectors 37A, 37B.

Two "C"-shape concave guiding rails (not shown) may be added, one horizontally and transversely fastened on the inner side of the front side-wall 111, at the same level of strip-tail connectors 37A, 37B, and the other of the rear side-wall 113 also at same level, with the two rails' openings facing toward strip-tail connectors 37A, 37B, to grip both ends of strip-tail connectors 37A, 37B to force strip-tail connectors 37A, 37B retain linear left-right movements, without vertical jerky movements even when strip-tail connectors 37A, 37B's longitudinal edges experience uneven transverse and/or vertical forces along their longitudinal axis. To reduce friction, bearing structure may be added to the concave walls of the guiding rails.

(3) Transmission assembly 3, including: the left- and right-side screw shafts 36A, 36B, which link, on one hand, to driving source 2, the power input end of said transmission assembly, and, on the other hand, to the two strip-tail connectors 37A, 37B, the power output end of said transmission assembly as shown in FIGS. 2A to 4, in order to convert driving source 2's periodical, bi-direction rotations into periodical, horizontal, linear to-and-fro movements on strip-tail connectors 37A, 37B.

Transmission assembly 3 along with its driving source 2 may be replaced with linear actuators, linear guides/guideways, ball screw actuators, and the like, to save screw shafts 36A, 36B, aforesaid diagonal tension braces and concave guiding rails. Linear actuators comprising hydraulic cylinders or fluid cylinders are prone to leakage and need fluid pumps to operate and, hence, are not recommended for this invention. All the aforesaid replacement parts shall be installed horizontally or about horizontally on base 11 in order to have them smoothly linked to strip-tail connectors 37A, 37B and move said strip-tail connectors horizontally, or about horizontally, linearly transverse-wise in said frame's internal free space.

The skills and methods described in this section are applicable to the Mold 2 of all more-than-two phase embodiments.

(4) Two strip clusters, including Phase-A strip cluster 41A and Phase-B strip cluster 41B.

As shown in FIGS. 2A and 4, when motor 21 rotates forwardly, screw shafts 36A and 36B will coupled accordingly to move both strip-tail connector 37A, 37B linearly to the right, causing strip cluster 41A (Phase A) to be tightened and strip cluster 41B (Phase B) to be loosened, in synchronism. FIG. 2A exhibits a state where Phase-A strip cluster has been tightened while Phase-B strip cluster has been loosened. FIG. 3 is the top view of such state, while FIG. 4 is the front view.

Figure 2B:
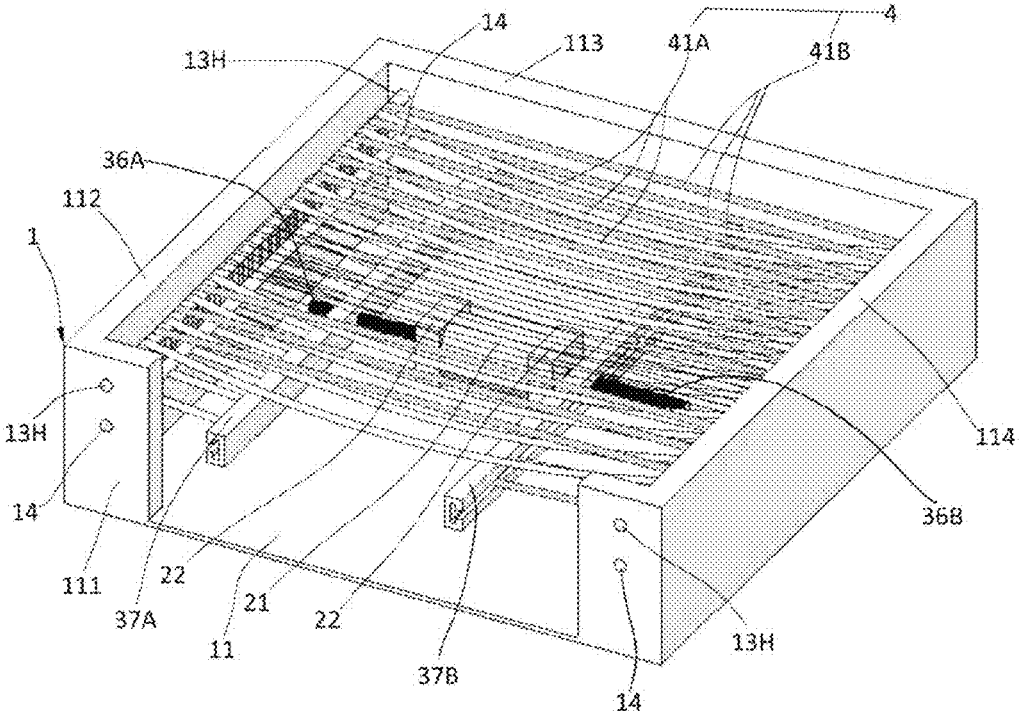
FIG. 2B: The structural view of another two-phase embodiment—Phase B strips being tightened while Phase A strips is loosened

On the same token, when motor 2 rotates reversely as shown in FIG. 2B, the above-mentioned directions will become opposite, causing Phase-B strip cluster to be tightened and Phase-A strip cluster to be loosened, in synchronism. FIG. 2B exhibits a state where Phase-B strip cluster has been tightened while Phase-A strip cluster has been loosened.

Figure 5:
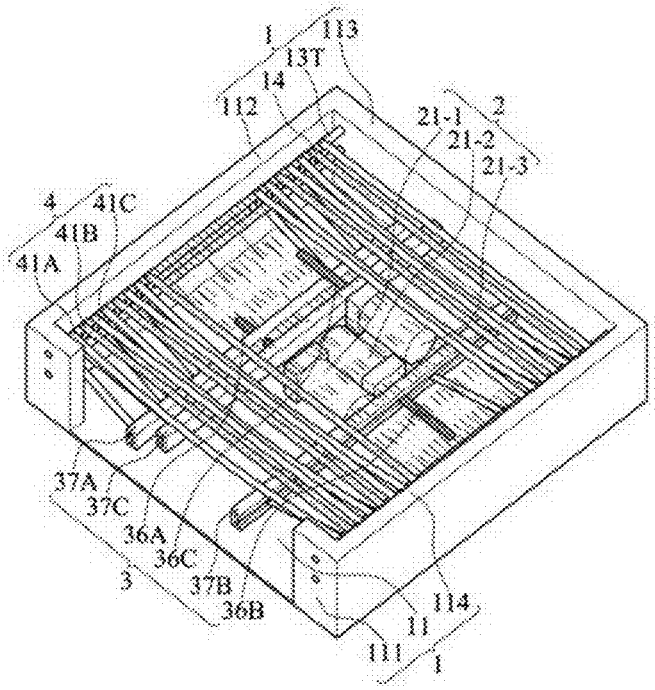

The more phases we used, the less average unit-area pressure we will obtain for the user's strip-contacted body area. One of the invention's three-phase embodiments is shown in FIG. 5, the subsystems of which comprise: (a) a frame, (b) three driving sources, (c) three transmission assemblies, each including a screw shaft and a strip-tail connector which is separate from said frame and can horizontally, or about horizontally, move linearly transverse-wise in said frame's internal free space, and (d) three transverse strip clusters interleaved in numerical phase sequence and in parallel, representing the three phases, Phases A, B and C. As shown in FIG. 5, frame 1 includes a base 11, the base's front-, left-, rear-, and right-side wall boards 111~114, a right-top special fastening rod 13T, fastening the strip heads of Phases A and C (collectively called "odd phase") while being jointly used for Phase-B ("even phase") strips' (about) 90-degree turning, a left-top special fastening rod 13T fastening the even-phase strip heads while being jointly used for odd-phase strips' (about) 90-degree turning, and two longitudinal, strip-turning rods 14, being installed in the two opposite transverse sides, and the lower side, in frame 1. The strip-turning rods 14 are respectively used for the even-phase and the odd-phase strip clusters' second (about) 90-degree turning.

Figure 6:
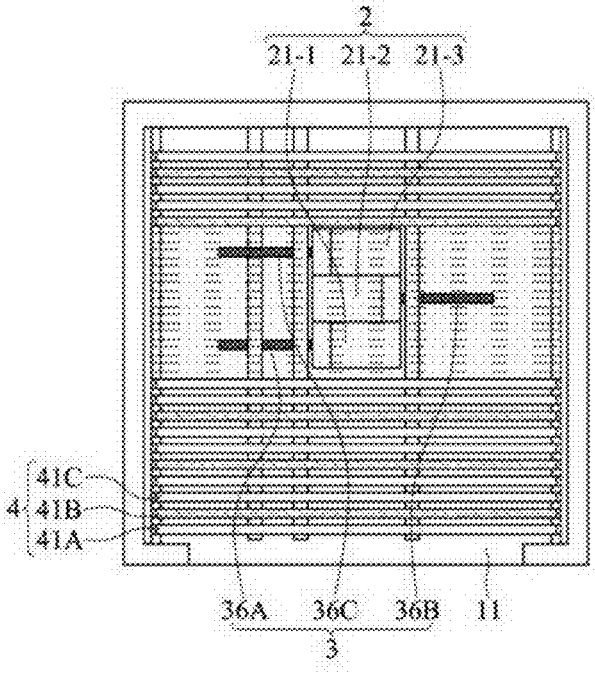
FIG. 6: The top view of FIG. 5
Figure 7:
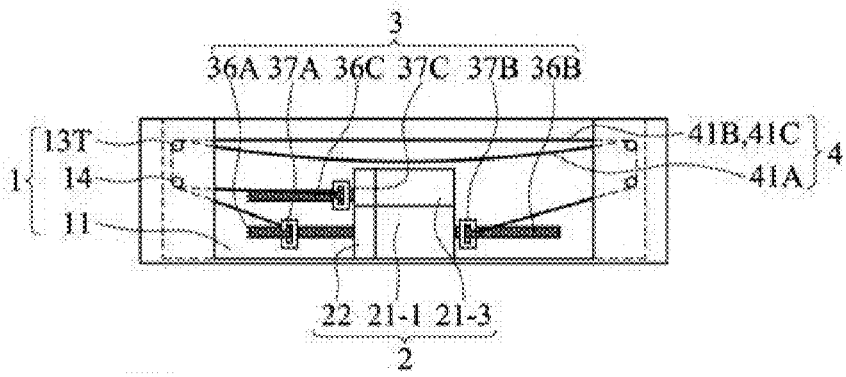
FIG. 7: The front view of FIG. 5

FIG. 5 shows a state where Phase-A strip cluster is loosened while Phases B and C strip clusters are tightened. FIG. 6 is the top view of such state, and FIG. 7 the perspective front view. FIGS. 6 and 7 show that the Mold 2 of the three-phase embodiments uses three driving sources 21-1, 21-2, 21-3 and three transmission assemblies 3, comprising three screw shafts 36A, 36B, 36C and three strip-tail connectors 37A, 37B, 37C which are separate from said frame and can horizontally, or about horizontally, move linearly transverse-wise in said frame's internal free space.

For the embodiments of over three phases, they can be carried out based on the aforesaid instructions and, hence, need not be further described.

Without departing the concepts and principles of this invention, frame 1's shape and size along with the specifications of the related parts and components may be adjusted to apply the present invention to other forms of body support for pressure-ulcer prevention, such as a mattress atop a bed or a bed if said down-facing hole at each of said base's four corners is inserted with a leg for supporting a lying human body. Taking the Mold 1 of the two-phase embodiments as an example, as shown in FIG. 1, the present invention may be used to support a lying human body once the top area of frame 1 is expanded to one that is similar to a single-bed size by: (a) extending the longitudinal length of base 11, strip-head fastening rods 13, strip-turning rods 14, and strip-tail connectors 37A, 37B, which are separate from said frame and can horizontally, or near horizontally, move linearly transverse-wise in said frame's internal free space, to one that is somewhat greater than an adult's height; accordingly, increasing the longitudinal spacing between the two bearing sets 34 and the longitudinal range of the two belts 32, (b) expanding the transverse width of base 11 and screw shafts 36A, 36B to approximately a single-bed width, and (c) increasing the number of strips for each strip cluster to fully cover the extended longitudinal length.

Figure 8:
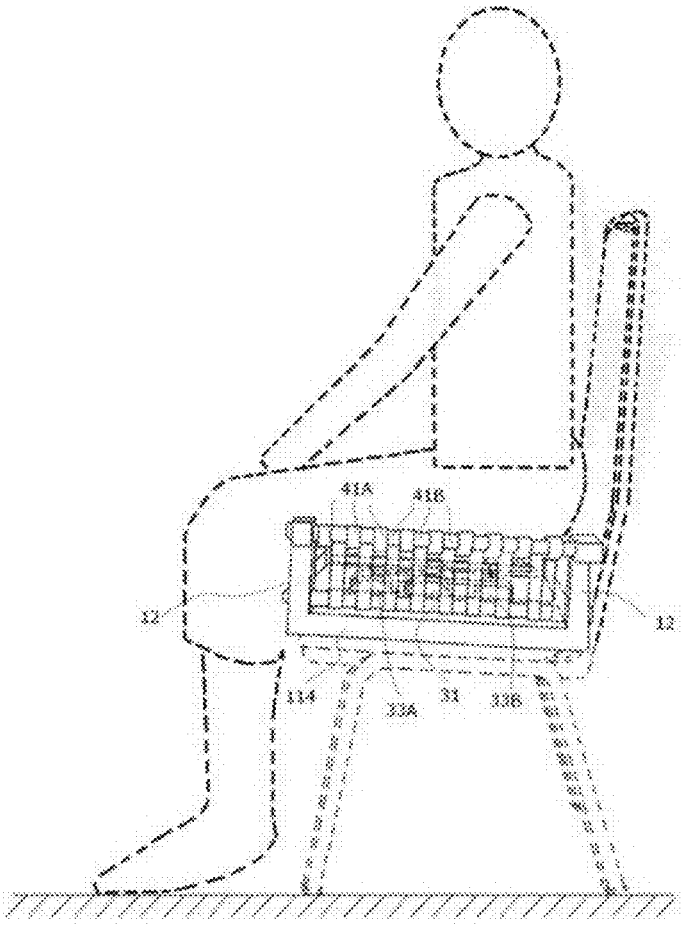
FIG. 8: One application example of the present invention

One of the many possible practical application examples of this invention is shown in FIG. 8.

Many other embodiments or modifications and variations of this invention are possible by the concepts stated and skills revealed herein. It is therefore apparent to those skilled in the art that various changes and modifications can be made without departing from this invention's scope and extent as defined by the appended claims.

The invention claimed is:

1. A dynamic cushion, comprising:

a frame;

a driving source;

a transmission assembly with a first and a second longitudinal strip-tail connector respectively connecting a first strip cluster representing a first, or odd, phase and a second strip cluster representing a second, or even, phase, via each corresponding strip cluster's tail, wherein said driving source's movements are converted into back-and-forth movements to drive said two strip-tail connectors evenly-spaced inside said frame and said two strip clusters are interleaved in parallel with said first strip cluster's head being fastened to said frame's one transverse side and said first strip cluster being transversely wrapped across said frame's top surface and other transverse side so as to fasten said tail of said first strip cluster to said first strip-tail connector and with said second strip cluster's head being fastened to said frame's said other transverse side and said second strip cluster being transversely wrapped across said frame's top surface and said one transverse side so as to fasten said tail of said second strip cluster to said second strip-tail connector, in order to produce periodic two-phase alternating tension and relaxation in said two strip clusters to avert any health hazards such as pressure ulcers.

2. The dynamic cushion of claim 1, wherein the frame comprises: a weight-support base, bearing the weight of said driving source and having four vertical posts respectively erected on the four corners of said base, two horizontal and longitudinal fastening rods respectively installed between, and near the top of, each two vertical posts in the frame's two opposite transverse sides to respectively fasten said strip clusters' heads, and two horizontal and longitudinal about 90° strip-turning rods respectively installed between, and near the bottom of, each two vertical posts in said frame's two opposite transverse sides in order to respectively bend the associated phases' strip clusters passing through about 90° from vertical to about horizontal direction in order to respectively link said strip clusters' tails to said longitudinal strip-tail connector pair which is separate from the frame and is transverse-wise linearly movable in said frame's internal lower space.

3. The dynamic cushion of claim 2, wherein the base's bottom is embedded with one down-facing hole at each of the four corners to be left open when said cushion is used as a dependent cushion of a chair, bed, or the like, normally having legs, but to be optionally inserted with a support leg slightly smaller than said hole in cross section when said cushion needs legs to convert it into an independent chair, bed, or the like with legs.

4. The dynamic cushion of claim 2, wherein the two strip clusters, each comprising plural strips, are interleaved with the other phase's strips in parallel and in sequence, and one end, or the head, of odd-phase strip cluster is fastened to a special fastening rod placed longitudinally in the upper side of said frame's one transverse side, with said odd-phase strips being wrapped across said frame's top surface, the other transverse side and into that side's lower side after about 180°'s wrapping in the same direction where said odd-phase strip cluster's the other end, or tail, is fastened to a corresponding longitudinal strip-tail connector placed in said frame's other transverse side, whereas one end, or the head, of even-phase strip cluster is fastened to the other special fastening rod placed longitudinally in the upper side of said frame's said other transverse side, with said even-phase strips being wrapped across said frame's top surface, said one transverse side and into that side's lower side after about 180°'s wrapping in the same direction where said even-phase strip cluster's the other end, or tail, is fastened to the other corresponding longitudinal strip-tail connector placed in said frame's said one transverse side.

5. The dynamic cushion of claim 2 or 4, wherein the fastening rods are rigid and straight, and the strip-tail connectors are rigid and strip-shaped and have at least a through hole along their transverse direction, preferably being symmetric longitudinally between their front and rear ends respectively, for a mechanical linkage to said transmission assembly.

6. The dynamic cushion of claim 1, wherein the frame's top surface area is expanded to about a single-bed size with the number of strips being increased accordingly to support a lying human body so that said cushion can be placed atop a bed like a mattress if said down-facing hole at each of said base's four corners is left open and not inserted with a said optional leg.

7. The dynamic cushion of claim 1, wherein the driving source comprises a motor linked with a gearbox and firmly attached on said base.

8. The dynamic cushion of claim 1, wherein the transmission assembly comprises: a pulley, being connected to said gearbox; a pulley pair, being respectively linked with a belt to said pulley connected to said gearbox; a parallel transverse-wise screw-shaft pair, which respectively penetrates through said pulley pair and a nut-plug pair, with the pulley and nut-plug pairs being respectively fastened to each other in order to respectively rotate together around said screw-shaft pair to move said screw-shaft pair linearly, with both ends of said transverse screw-shaft-pair being respectively fastened to said longitudinal parallel strip-tail connector pair linearly movable in said frame's internal space.

9. A dynamic cushion, comprising:

a frame;

a driving source;

a transmission assembly with a power input end and a power output end, which respectively link to said driving source and to a first, or first phase, and a second, or second phase, longitudinal strip-tail connector respectively connecting a first, or first phase, and a second, or second phase, strip cluster, said two strip-tail connectors being evenly spaced, located at said frame's internal space and driven indirectly by said driving source to move back and forth, said two strip clusters being interleaved in parallel with said first strip cluster's head being fastened to said frame's one transverse side and said first strip cluster being transversely wrapped across said frame's top surface and other transverse side so as to fasten said first strip cluster's tail to said first strip-tail connector and with said second strip cluster's head being fastened to said frame's said other transverse side and said second-phase strip cluster being transversely wrapped across said frame's top surface and said one transverse side so as to fasten said second strip cluster's tail to said second strip-tail connector in order to make said two strip clusters produce periodic two-phase alternating tension and relaxation to avert any health hazards such as pressure ulcers.

10. The dynamic cushion of claim 9, wherein the frame comprises: a weight-support base, which is installed under said strip clusters and bears the weight of said driving source; two special fastening rods, one jointly used for one phase's strip-head fastening and the other phase's first about 90° strip turning, and the other for said other phase's strip-head fastening and said one phase's first about 90° strip turning, both special fastening rods being respectively installed in the upper side of said frame's two opposite transverse sides; and two about 90° strip-turning rods, respectively installed in the bottom side of said frame's two opposite transverse sides, for the second strip turning of both phases so as to respectively bend said two phases' strip clusters about 180° from said two fastening rods into an about opposite direction to respectively reach said frame's lower opposite transverse sides, wherein said two phases' strip tails are respectively fastened according to their phase sequence to said two phases' parallel strip-tail connectors linearly movable transverse-wise in said frame's lower internal space.

11. The dynamic cushion of claim 9, wherein the transmission assembly comprises a transverse screw shaft pair placed in said transmission assembly's both opposite transverse sides, and the inner side of said two screw shafts is respectively and mechanically linked to said driving source so as to make said screw shafts rotate with said driving source, with the outer side of said screw shaft pair being respectively connected to said parallel longitudinal strip-tail connector pair in order to induce synchronized linear, horizontal movements transverse-wise to said strip-tail connector pair when said driving source rotates.

12. The dynamic cushion of claim 11, wherein the parallel longitudinal strip-tail connector pair's longitudinal central area is respectively drilled with a transverse-wise through hole, the wall of said through hole being threaded to match said screw shaft pair in order to respectively induce synchronized linear movements to said strip-tail connector pair by said screw shaft pair, respectively, in said frame's lower internal space as said screw shaft pair is respectively driven by, and respectively rotates with, said driving source.

13. The dynamic cushion of claim 11, wherein the driving source is a motor having two output shafts protruding from both sides of said motor, said two output shafts being respectively linked to two speed-reduction gearboxes, with the two output axes of said two gearboxes being respectively linked to said transmission assembly's two transverse-wise screw shafts in an about straight line so as to respectively drive said parallel longitudinal strip-tail connector pair.

14. The dynamic cushion of claim 11, wherein the driving source is a longitudinally-placed single-shaft motor, said motor's shaft being linked to a reduction gearbox having one input axis perpendicular to two transverse-wise in-line output axes protruding in the two opposite transverse sides of said gearbox, with said two gearbox output axes being respectively connected to said screw shaft pair so as to respectively drive said parallel longitudinal strip-tail connector pair.

15. A dynamic cushion, comprising:

a frame;

three driving sources;

three transmission assemblies with a first, namely first phase or first odd-phase, a second, namely second phase or first even-phase, and a third, namely third phase or second odd-phase, longitudinal strip-tail connector respectively linking to a first, namely first phase or first odd-phase, a second, namely second phase or first even-phase, and a third, namely third phase or second odd-phase, strip cluster, each one end of said three transmission assemblies being linked to each of said three driving sources respectively, and each other end to each of said three strip-tail connectors respectively, wherein the two odd-phase strip-tail connectors and the even-phase strip-tail connector are respectively located at said frame's two transverse sides and respectively driven by said three driving sources indirectly in sequence and said three strip clusters are interleaved in sequence and in parallel to constitute said frame's top surface, with said odd-phase strip clusters' heads being fastened to said frame's one transverse side and said odd-phase strip clusters being transversely wrapped across said frame's top surface and other transverse side so as to fasten said odd-phase strip clusters' two tails to said two odd-phase strip-tail connectors respectively and with said even-phase strip cluster's head being fastened to said frame's said other transverse side and said even-phase strip cluster being transversely wrapped across said frame's top surface and said one transverse side so as to fasten said even-phase strip cluster's tail to said even-phase strip-tail connector, in order to produce periodic three-phase alternating tension and relaxation in said three strip clusters to avert any health hazards such as pressure ulcers.

16. The dynamic cushion of claim 15, wherein the frame comprises: a weight-support base, which is installed under said strip clusters and bears the weight of said three driving sources; two special fastening rods, one being jointly used for the first and the third phases' strip-head fastening and the second phase's first about 90° strip turning, and the other for said second phase's strip-head fastening and said first and said third phases' first about 90° strip turning, both special fastening rods being respectively installed in the upper side of said frame's two opposite transverse sides; and two about 90° strip-turning rods respectively installed near said frame's two lower opposite transverse sides, one for the second about 90° strip turning of said first and said third phases' strip clusters and the other for the second about 90° strip turning of said second phase's strip cluster so as to respectively bend said three phases' strip clusters about 180° from said two respective fastening rods to an about opposite direction respectively to reach said frame's lower opposite transverse sides where said three phases' strip tails are respectively fastened according to their phase sequence to said three phases' parallel strip-tail connectors.

17. The dynamic cushion of claim 16, wherein the transmission assemblies comprise three transverse screw shafts, with the first and the third phases' screw shafts being respectively installed to point to one transverse side in said frame, and the second phase's screw shaft to point to the other transverse side in said frame, the inner side of said three screw shafts being respectively and mechanically linked to said three driving sources so as to rotate with said driving sources respectively, and the outer side of said three screw shafts being respectively connected to said three longitudinal strip-tail connectors linearly movable transverse-wise in said frame's internal space, with the first and the third phases' strip-tail connectors respectively placed in one transverse side in said frame and the second phase's strip-tail connector placed in the other opposite transverse side in said frame so as to induce periodic, linear, horizontal, transverse-wise movements in sequence to said three strip-tail connectors.

18. A dynamic cushion, comprising:

a frame;

multiple driving sources, respectively corresponding to multiple phases, wherein at least one phase is an even-phase, and at least one phase is an odd-phase, and wherein each phase has a strip-tail connector;

multiple transmission assemblies, respectively corresponding to said multiple phases, each having a corresponding power input end and a corresponding power output end that respectively link to its phase's driving source and said phase's strip-tail connector, which is located inside said frame and connects one end, or the tail, of said phase's strip cluster having the other end as the head, wherein each transmission assembly converts its said power input end's movements into back-and-forth movements at its said power output end, or strip-tail connector, and all phases' strip clusters are interleaved in parallel, with the head(s) of odd-phase strip cluster(s) being fastened to said frame's one transverse side in phase sequence and said odd-phase strips being transversely wrapped across said frame's top surface and other transverse side so as to fasten said tail(s) of said odd-phase strip cluster(s) to a corresponding strip-tail connector (corresponding strip-tail connectors) in phase sequence, and with the head(s) of even-phase strip cluster(s) being fastened to said frame's said other transverse side in phase sequence and said even-phase strips being transversely wrapped across said frame's top surface and said one transverse side so as to fasten said tail(s) of said even-phase strip cluster(s) to the other corresponding strip-tail connector (other corresponding strip-tail connectors) in phase sequence, in order to produce periodic multiple-phase alternating tension and relaxation in all strip clusters to avert any health hazards such as pressure ulcers.

19. The dynamic cushion of claim 18, wherein the frame comprises: a weight-support base, which is installed under said strip clusters and bears the weight of said driving sources; two special fastening rods, one jointly used for the odd phase's (phases') strip-head fastening and the even phase's (phases') first about 90° strip turning, and the other for said even phase's (phases') strip-head fastening and said odd phase's (phases') first about 90° strip turning, both special fastening rods being respectively installed in the upper side of said frame's two opposite transverse sides; and two about 90° strip-turning rods respectively installed near the bottom side of said frame's two opposite transverse sides for the second about 90° strip turning of both said odd and said even phases respectively so as to respectively bend said odd and said even phases' strip clusters about 180° respectively from said two fastening rods into an about opposite direction to respectively reach said frame's lower opposite transverse sides where said odd and said even phases' strip tails are respectively fastened according to their phase sequence to said odd and said even phase's (phases') parallel strip-tail connectors linearly movable transverse-wise in said frame.

20. The dynamic cushion of claim 18, wherein the frame's top surface area is expanded to about a single-bed size with the number of strips being increased accordingly to support a lying human body so that said cushion can be placed atop a bed like a mattress if said down-facing hole at each of said base's four corners is left open without any said optional leg inserted.

* * * * *